US005755944A

United States Patent [19]

Haven et al.

[11] Patent Number: 5,755,944

[45] Date of Patent: May 26, 1998

[54] FORMATION OF LAYER HAVING OPENINGS PRODUCED BY UTILIZING PARTICLES DEPOSITED UNDER INFLUENCE OF ELECTRIC FIELD

[75] Inventors: Duane A. Haven, Cupertino; Esther Sluzky, San Diego; John M. Macaulay, Palo Alto, all of Calif.

[73] Assignee: Candescent Technologies Corporation, San Jose

[21] Appl. No.: 660,535

[22] Filed: Jun. 7, 1996

[51] Int. Cl.[6] ..... C23D 13/02

[52] U.S. Cl. ..... 204/486; 204/490; 204/492; 205/109

[58] Field of Search ..... 204/486, 490, 204/492; 205/109

[56] References Cited

U.S. PATENT DOCUMENTS

| | | | |
|---|---|---|---|
| 3,497,929 | 3/1970 | Shoulders | 29/25.17 |
| 3,595,762 | 7/1971 | Chessin | 205/109 |
| 3,665,241 | 5/1972 | Spindt et al. | 313/351 |
| 3,755,704 | 8/1973 | Spindt et al. | 313/309 |
| 3,970,887 | 7/1976 | Smith et al. | 313/309 |
| 3,998,678 | 12/1976 | Fukase et al. | 313/309 |
| 4,008,412 | 2/1977 | Yuito et al. | 313/309 |
| 4,940,916 | 7/1990 | Borel et al. | 313/309 |
| 5,007,873 | 4/1991 | Goronkin et al. | 313/309 |
| 5,053,673 | 10/1991 | Tomii et al. | 313/309 |
| 5,150,019 | 9/1992 | Thomas et al. | 313/309 |
| 5,150,192 | 9/1992 | Greene et al. | 313/309 |
| 5,164,632 | 11/1992 | Yoshida et al. | 313/309 |
| 5,170,092 | 12/1992 | Tommi et al. | 313/309 |
| 5,194,780 | 3/1993 | Meyer | 313/309 |
| 5,249,340 | 10/1993 | Kane et al. | 29/25.02 |
| 5,277,638 | 1/1994 | Lee | 445/50 |

(List continued on next page.)

FOREIGN PATENT DOCUMENTS

| | | |
|---|---|---|
| 0 416 625 A2 | 3/1991 | European Pat. Off. . |
| 0 508 737 A1 | 10/1992 | European Pat. Off. . |

OTHER PUBLICATIONS

Betsui, "Fabrication and Characteristics of Si Field Emitter Arrays," *Tech. Dig. IVMC* 91, 1991, pp. 26–29, no month available.

Busta, "Vacuum Microelectronics——1992," *J. Micromech. Microeng.*, vol. 2, 1992, pp. 43–74, no month available.

Cochran et al, "Low-voltage Field Emission from Tungsten Fiber Arrays in a Stabilized Zirconia Matrix," *J. Mater. Res.*, May/Jun. 1987, pp. 322–328.

Huang et al, "200-nm Gated Field Emitters", *IEEE Electron Device Letters*, Mar. 1993, pp. 121–122.

Spindt et al, "Physical Properties of Thin-film Field Emission Cathodes with Molybdenum Cones," *J. Appl. Phys.*, Dec. 1976, pp. 5248–5263.

Spindt et al, "Research in Micron-size Field-emission Tubes," *IEEE Conf. Record*, 1966 *Eighth Conf. Tube Techinques*, 20–22 Sep. 1966, pp. 143–147.

(List continued on next page.)

*Primary Examiner*—Kathryn L. Gorgos
*Assistant Examiner*—Kishor Mayekar
*Attorney, Agent, or Firm*—Skjerven, Morrill, MacPherson, Franklin, & Friel LLP; Ronald J. Meetin

[57] ABSTRACT

A method for creating a solid layer (36A or 52A) through which openings (38 or 54) extend entails subjecting particles (30) suspended in a fluid (26) to an electric field ($E_A$) to cause a number of the particles to move towards, and accumulate over, a structure placed in the fluid. The structure, including the so-accumulated particles, is removed from the fluid. Solid material is deposited over the structure at least in the space between the so-accumulated particles. The particles, including any overlying material (36B or 52B), are removed. The remaining solid material forms the solid layer through which openings extend at the locations of the so-removed particles. The structure is typically a layer is then typically either a gate layer for the electron-emitting device or a layer used in forming the gate layer.

36 Claims, 4 Drawing Sheets

U.S. PATENT DOCUMENTS

| | | | |
|---|---|---|---|
| 5,316,511 | 5/1994 | Lee | 445/50 |
| 5,458,520 | 10/1995 | DeMercurio et al. | 445/50 |
| 5,462,467 | 10/1995 | Macaulay et al. | 445/50 |
| 5,559,389 | 9/1996 | Spindt et al. | 313/351 |
| 5,564,959 | 10/1996 | Spindt et al. | 445/50 |
| 5,676,853 | 10/1997 | Alwan | 216/11 |

OTHER PUBLICATIONS

Williams et al. "Fabrication of 80 Å Metal Wires," *Rev. Sci. Instrum.*, Mar. 1984, pp. 410–412.

Sune et al. "Fabrication of Silicon–Column–Field Emitters for Microwave Applications," *Tech. Dig., 6th Int'l Vac. Microelec. Conf.*, 12–15 Jul. 1993, pp. 15–16.

FORMATION OF LAYER HAVING OPENINGS PRODUCED BY UTILIZING PARTICLES DEPOSITED UNDER INFLUENCE OF ELECTRIC FIELD

CROSS REFERENCE TO RELATED APPLICATION

This contains subject matter partially similar to Haven et al, co-filed U.S. patent application Ser. No. 08/660,537, filed Jun. 7, 1996, still pending.

FIELD OF USE

This invention relates to the formation of solid layers through which openings extend. This invention also relates to the utilization of such a layer in fabricating an electron-emitting device, commonly referred to as a cathode, suitable for a product such as a cathode-ray tube ("CRT") of the flat-panel type.

BACKGROUND ART

A field-emission cathode (or field emitter) emits electrons upon being subjected to an electric field of sufficient strength. The electric field is produced by applying a suitable voltage between the cathode and an electrode, typically referred to as the anode or gate electrode, situated a short distance away from the cathode.

When a field-emission cathode is utilized in a flat-panel CRT display, electron emission from the cathode commonly occurs across a sizable area. The electron-emitting area is typically divided into a two-dimensional array of electron-emissive portions, each situated opposite a corresponding light-emitting portion to form part or all of a picture element (or pixel). The electrons emitted by each electron-emitting portion strike the corresponding light-emitting portion and cause it to emit visible light.

It is generally desirable that the illumination be uniform (constant) across the area of each light-emitting portion. One method for achieving uniform illumination is to arrange for electrons to be emitted uniformly across the area of the corresponding electron-emitting portion. This typically involves fabricating each electron-emitting portion as a group of small, closely spaced electron-emissive elements.

Various techniques have been investigated for manufacturing electron-emitting devices that contain such electron-emissive elements. Spindt et al, "Microfabrication in Micron-Size Field-Emission Tubes," IEEE Conf. Record 1966 8th Conf. Tube Techniques, 20 Sep., 1966, pages 143–147, describes how small randomly distributed spherical particles are employed to define the locations for conical electron-emissive elements in a flat field-emission cathode.

In fabricating an electron-emitting diode having a thick anode, Spindt et al first creates a structure in which an upper molybdenum layer overlies an intermediate dielectric layer situated on a lower molybdenum layer. Spherical polystyrene particles are scattered across the upper molybdenum layer after which "resist", typically alumina, is deposited on top of the structure. Generally circular openings are created through the resist by removing the spheres, thereby removing portions of the resist situated on the spheres.

The upper molybdenum and intermediate dielectric layers are etched through the resist openings to form corresponding generally circular openings through the upper molybdenum and dielectric layers down to the lower molybdenum layer. Conical electron-emissive elements are subsequently formed in the openings in the intermediate dielectric layer, one electron-emissive cone per opening, by evaporatively depositing molybdenum through the dielectric openings and onto the lower molybdenum.

The fabrication process described in Spindt et al is of significant interest. However, simply scattering spherical particles across a surface leaves the distribution of the spheres to the laws of chance. Some spheres may touch one another, thereby leading to electron-emissive elements of non-conical, and therefore typically undesirable, shape.

More particularly, if non-circular openings created as the result of touching spheres are present in the upper molybdenum layer of Spindt et al during the evaporative deposition of molybdenum through circular openings in the upper molybdenum to form electron-emissive cones on the lower molybdenum layer, the evaporatively deposited molybdenum passes through each non-circular opening in the upper molybdenum layer and accumulates on the lower molybdenum to form an electron-emissive structure shaped generally like a group of cones merged together and having one or more tips. With the fabrication process being geared toward forming conical electron-emissive elements, the tips of the merged-cone structures are normally not as sharp as the tips of the electron-emissive cones. Consequently, the turn-on voltage for the merged-cone structures is normally greater than the turn-on voltage for the cones. This, in turn, leads to non-uniform electron emission across the electron-emitting area.

In utilizing particles to create openings through a layer formed in the space between the particles, it would be desirable to distribute the particles across a surface according to a technique that significantly inhibits the particles from touching one another along the surface, particularly when the so-created openings are utilized in defining the locations of electron-emissive elements in an area electron emitter that needs to provide highly uniform electron emission.

GENERAL DISCLOSURE OF THE INVENTION

The present invention employs such a technique for distributing particles across a surface in creating openings through a layer formed in space between the particles. In the invention, particles suspended in a fluid accumulate on a surface upon being subjected to an electric field of appropriate strength. This procedure is generally termed electrophoretic deposition or dielectrophoretic deposition depending on whether the particles, typically spherical in shape, are charged or uncharged. Due to the nature of the electrophoretic or dielectrophoretic deposition process, the particles are significantly inhibited from touching one another along the deposition surface provided that (a) the surface density of the particles amounts to significantly less than a monolayer of the particles, (b) the deposition conditions are appropriately controlled, and (c) the particles and deposition surface have suitable characteristics.

The electrophoretically/dielectrophoretically deposited particles are subsequently employed in forming openings in a layer. These openings are preferably used in defining the locations for electron-emissive elements of an area electron emitter. Because the particles are significantly inhibited from touching one another, the percentage of electron-emissive elements produced with undesirable shapes is significantly reduced. For example, when the technique of the invention is used in a process for creating electron-emissive elements that are intended to be conical in shape, the percentage of electron-emissive elements formed as undesirable merged-cone structures is quite low.

Accordingly, the resultant electron emitter is capable of providing highly uniform electron emission.

More particularly, in accordance with the invention, particles suspended in the fluid are first subjected to an electric field to cause a multiplicity of the particles to move towards, and accumulate over, a major surface of a structure placed in the fluid. The particles typically are electrically charged. The charge may be present on the particles prior to the stage at which they are combined with the fluid but can be applied to the particles when they are combined with the fluid as the result of a particle-charging component in the fluid. In some cases, the particles are uncharged, especially when they can be polarized and the electric field is of a suitable non-uniform convergent nature. The fluid is typically a liquid but can be a gas.

The structure, including the so-accumulated particles, is removed from the fluid. Solid material is then deposited over the major surface of the structure at least in space between the particles. The multiplicity of particles, including any material overlying the particles, is removed from the structure. The remaining selected solid material forms a solid layer through which a like multiplicity of openings extend at the locations of the so-removed particles.

The structure typically contains a lower electrically non-insulating region and an overlying electrically insulating layer. As discussed below, "electrically non-insulating" means electrically conductive or electrically resistive. The solid layer is situated over the insulating layer. With the solid layer serving as an etch mask, the insulating layer is etched through the openings in the solid layer to form corresponding dielectric openings through the insulating layer substantially down to the lower non-insulating region. The resulting structure can be used for various purposes.

The structure is preferably employed as part of a gated electron-emitter. In this case, electron-emissive elements are formed over the lower non-insulating region. Each electron-emissive element is at least partly situated in a corresponding one of the dielectric openings. In one example, the solid layer itself forms the gate layer of the electron emitter. In another example, before performing the electrophoretic/dielectrophoretic particle deposition, the structure is provided with a separate gate layer that lies between the insulating layer and the solid layer. The gate layer is etched through the openings in the solid layer to form gate openings through the gate layer after which the dielectric openings and electron-emissive elements are formed.

In a further example where the solid layer preferably forms the gate layer, the openings in the solid layer thereby being gate openings, the structure is provided with an intermediate layer that lies between the insulating layer and the solid layer. The intermediate layer inhibits clumping of the particles during the electrophoretic/dielectrophoretic deposition. This enables the particle surface density to be increased, especially when the solid layer is the gate layer. The intermediate layer also typically serves as an adhesion layer.

Processing of the structure in the last-mentioned example after performing the electrophoretic/dielectrophoretic deposition and removing the particles typically entails etching the intermediate layer through the gate openings to form corresponding openings through the intermediate layer. The insulating layer is then etched through the intermediate and gate openings to form corresponding dielectric openings through the insulating layer down to a lower electrically non-insulating region. Electrically non-insulating emitter material is deposited over the gate layer and into the gate openings to at least partially form electron-emissive elements above the lower non-insulating region. At least part of the emitter material accumulated over the gate layer is electrochemically removed. Combining the electrophoretic/dielectrophoretic particle deposition with electrochemical removal of excess emitter material enables the electron emitter to be fabricated in a highly efficient manner.

By fabricating an electron emitter in any of the foregoing ways, the locations of the electron-emissive elements are generally centered vertically on the locations of the electrophoretically/dielectrophoretically deposited particles. Consequently, the electron emission is highly uniform across the electron emitting area. The invention provides a substantial advance over the prior art.

BRIEF DESCRIPTION OF THE DRAWINGS

Like reference symbols are employed in the drawings and in the description of the preferred embodiments to represent the same, or very similar, item or items.

DESCRIPTION OF THE PREFERRED EMBODIMENTS

Figure 1A:
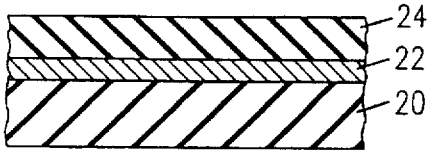
FIGS. 1*a*–1*i* are cross-sectional structural views representing a set of steps in manufacturing a gated electron emitter utilizing electrophoretic deposition in accordance with the invention.

The present invention utilizes particles electrophoretically and/or dielectrophoretically distributed across a surface of a structure to define openings in a gate electrode for a gated field-emission cathode. Each field emitter fabricated according to the invention is suitable for exciting phosphor regions on a faceplate in a cathode-ray tube of a flat-panel video monitor for a personal computer, a lap-top computer, or a workstation.

The following electrical definitions are employed in the description below. The term "electrically insulating" (or "dielectric") generally applies to materials having a resistivity greater than $10^{10}$ ohm-cm. The term "electrically non-insulating" thus refers to materials having a resistivity below $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. These categories are determined at an electric field of no more than 1 volt/μm.

Examples of electrically conductive materials (or electrical conductors) are metals, metal-semiconductor compounds (such as metal silicides), and metal-semiconductor eutectics. Electrically conductive materials also include semiconductors doped (n-type or p-type) to a moderate or high level. Electrically resistive materials include intrinsic and lightly doped (n-type or p-type) semiconductors. Further examples of electrically resistive materials are (a) metal-insulator composites such as cermet (ceramic with embedded metal particles), (b) forms of carbon such as graphite, amorphous carbon, and modified (e.g., doped or laser-modified) diamond, (c) and certain silicon-carbon compounds such as silicon-carbon-nitrogen.

Referring to the drawings, FIGS. 1*a*–1*i*(collectively "FIG. 1") illustrate a process for manufacturing a gated field-emission cathode according to the teachings of the invention using an electrophoretic technique to deposit spherical particles that define openings in the cathode's gate layer. The starting point for the fabrication process of FIG. 1 is an electrically insulating substrate 20 typically consisting of ceramic or glass. See FIG. 1*a*. Substrate 20, which furnishes support for the field emitter, is configured as a plate. In a flat-panel CRT display, substrate 20 constitutes at least part of the backplate.

A lower electrically non-insulating emitter region 22 is provided along the top of substrate 20 as indicated in FIG. 1*a*. Although not explicitly depicted in FIG. 1*a*, lower non-insulating region 22 typically consists of a lower electrically conductive layer and an upper electrically resistive layer. The lower conductive layer is usually formed with a metal such as chromium or nickel. The upper resistive layer typically consists of cermet or a silicon-carbon-nitrogen compound.

At least the lower conductive layer of lower non-insulating region 22 is typically patterned into a group of parallel emitter-electrode lines referred to as row electrodes. When region 22 is configured in this way, the final field-emission structure is particularly suitable for selectively exciting phosphors in a flat-panel display. Nonetheless, region 22 can be arranged in various other patterns, or can even be unpatterned.

A largely homogenous electrically insulating layer 24 is provided on top of the structure. Depending on how lower non-insulating region 22 is configured, parts of insulating layer 24 may contact substrate 20. Layer 24 typically consists of silicon oxide or silicon nitride. Part of layer 24 later becomes the emitter/gate interelectrode dielectric.

The thickness of insulating layer 24 should be sufficiently great that the later-created electron-emissive elements are shaped as cones whose tips extend slightly above the top of layer 24. The height of each electron-emissive cone depends on its base diameter which, as described below, is determined by the diameter of a spherical particle used in defining a gate opening for that electron-emissive cone. The thickness of insulating layer 24 is normally slightly greater than the diameter of the spherical particles. A typical range for the insulating layer thickness is 0.1–3 μm, typically 0.3–0.35 μm.

Figure 1B:
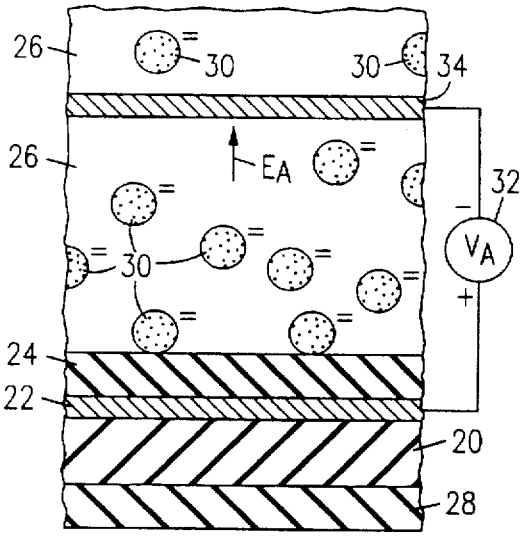

Resulting structure 20/22/24 is placed in fluid 26 of an electrophoretic deposition apparatus as generally shown in FIG. 1*b*. Structure 20/22/24 sits on bottom plate 28 of the electrophoretic deposition apparatus and is fully covered by fluid 26. Typically, fluid 26 is a liquid, preferably ethanol. Alternatively, fluid 26 can be a gas such as nitrogen.

Solid spherical particles 30 are suspended in fluid 26. Spherical particles 30 may be introduced into fluid 26 before or after placing structure 20/22/24 into fluid 26. Particles 30 are charged, typically with negative charge. FIG. 1*b* illustrates an example in which each of spheres 30 bears at least one double negative charge.

Spherical particles 30 are typically formed with polystyrene. In this case, each double negative charge on a particle 30 typically arises from the attachment of a carboxyl group to that particle 30. Alternative materials for particles 30 include glass (e.g., silicon oxide), polymers (e.g., latex) other than polystyrene, and polymers coated with functional groups such as alcohol, acid, amide, and sulfonate groups.

The charge can be placed on particles 30 before or after they are introduced into fluid 26. For a polymer such as polystyrene, electrically charged groups that provide the charge are present on particles 30 before they are introduced into fluid 26. In particular, the carboxyl groups attached to polystyrene terminate the precursor monomer that forms polystyrene. For glass and other materials that are normally neutral (electrically uncharged), fluid 26 is provided with a charge-inducing component such as an appropriate surfactant. When particles 30 are made of a normally uncharged material, particles 30 become electrically charged upon being introduced into fluid 26.

When particles 30 consist of polystyrene, they have a diameter of 0.1–3 μm, typically 0.3 μm. The standard deviation in the average particle diameter is normally very small, less than 10%, typically 2%. For the case in which fluid 26 and spheres 30 consist respectively of ethanol and polystyrene, the concentration of spheres 30 in fluid 26 is $10^8$–$10^{14}$ spheres/liter, typically $10^{11}$ spheres/liter.

A voltage source 32 applies a voltage $V_A$ between lower non-insulating region 22 and an electrode 34 situated above structure 20/22/24 in fluid 26. Applied voltage $V_A$ produces an applied electric field $E_A$ in the portion of fluid 26 between structure 20/22/24 and electrode 34. Non-insulating region 22 serves as the positive electrode, or anode, during the electrophoretic deposition. Upper electrode 34 is the negative electrode, or cathode. Accordingly, electric field $E_A$ is directed from positive electrode 22 to negative electrode 34.

With spherical particles 30 being negatively charged, electric field $E_A$ causes particles 30 located between structure 20/22/24 and negative electrode 34 to move (or migrate) towards insulating layer 24. Some of particles 30 accumulate on the upper surface of layer 24. Because particles 30 are negatively charged, the accumulation of a particle 30 at a particular point on the upper surface of layer 24 significantly inhibits other particles 30 from accumulating close to that particle 30, provided that the surface density of particles 30 on layer 24 is sufficiently low that the average spacing between particles 30 corresponds to substantially less than a monolayer of particles 30.

Also, the degree to which particles 30 are inhibited from touching one another along the upper surface of layer 24 depends on the particle deposition conditions, the characteristics of the deposition surface including surface preparation steps performed on the deposition surface, and the particle characteristics including the functional groups attached to particles 30. Instances of particle clumping are typically reduced when the deposition surface is clean.

The particle accumulation rate on insulating layer 24 depends (among other things) on the magnitude of applied voltage $V_A$ (or applied electric field $E_A$) and the density of particles 30 in fluid 26. Voltage $V_A$ is 1–300 volts depending on the electrode spacing, normally 2–15 cm when fluid 26 consists of ethanol. The electrode spacing typically increases as the area of the field emitter increases. For an electrode spacing of 3–10 cm when fluid 26 is ethanol, voltage $V_A$ is 5–100 volts, typically 20 volts.

Particles 30 are subjected to electric field $E_A$ for a time sufficient to accumulate a desired density of particles 30 on the upper surface of insulating layer 24. The surface density of particles 30 is usually $10^7$–$10^{11}$ particles/cm$^2$, typically $5\times10^8$ particles/cm$^2$ for a deposition time of 5 min. Because the negative charges on spheres 30 significantly inhibit them from touching one another (and clumping together), the particle surface density can be considerably higher than what would be tolerable if no measures were taken to inhibit particles from touching one another along the top of layer 24.

Spherical particles 30 adhere quite strongly to insulating layer 24. Van der Waals forces are believed to at least partially provide the attachment mechanism. When the desired particle-accumulation time is over, structure 20/22/24, with particles 30 attached to the upper surface of layer 24, is removed from the electrophoretic deposition apparatus and dried to produce the structure shown in FIG. 1*c*.

Figure 1C:
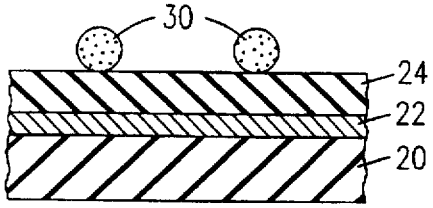
Figure 5:
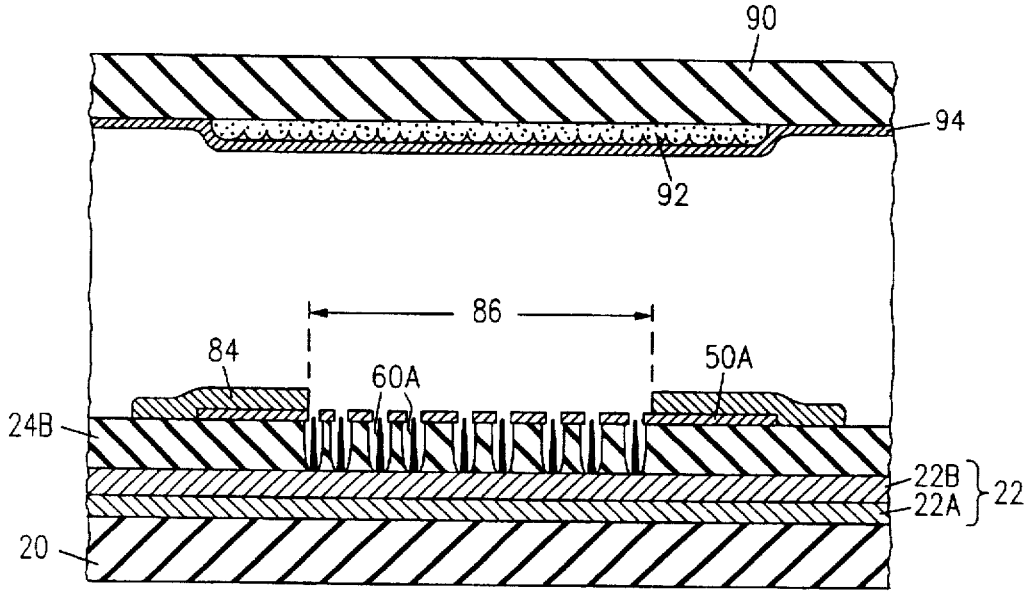
FIG. 5 is a cross-sectional structural view of a flat-panel CRT display that incorporates a gated electron emitter fabricated according to the invention.

In the embodiment of FIGS. 1*b* and 1*c*, particles 30 accumulate on a deposition surface (the upper surface of insulating layer 24) formed with only one type of material (silicon oxide or silicon nitride). However, as shown in FIG. 5 discussed below, particles 30 may accumulate on a deposition surface (or on deposition surfaces) formed with different types of materials. In this case, the particle surface density on a surface portion consisting of one type of material may differ significantly from the particle surface density on an adjacent or nearby surface portion formed with another type of material.

For example, when the electrophoretic deposition technique of the invention is performed on chromium surface portions in certain parts of a structure and simultaneously on silicon oxide surface portions of insulating layer 24 in other parts of the structure, the particle surface density on the chromium surface portions is considerably higher, typically several times higher, than the particle surface density on the silicon oxide surface portions. The electrophoretic particle deposition can thus be highly selective, depending on the deposition conditions, deposition surface characteristics, deposition surface preparation, particle characteristics, applied electric field, characteristics of fluid 26 in which particles 30 are suspended, and density of particles 30 in fluid 26.

Figure 1D:
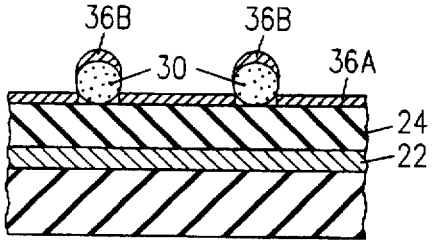

Electrically non-insulating gate material is deposited on top of structure 20/22/24/30, typically in a direction generally perpendicular to the upper surface of insulating layer 24. The gate material accumulates on layer 24 in space between particles 30 to form a gate layer 36A as shown in FIG. 1*d*. Portions 36B of the gate material accumulate simultaneously on the top halves (hemispheres) of particles 30.

The gate material deposition is typically performed by evaporation or collimated sputtering. The gate material usually consists of a metal such as chromium, nickel, molybdenum, titanium, tungsten, or gold. To avoid having gate material portions 36B bridge to gate layer 36A, the gate material thickness is normally less than the average radius of spheres 30.

Solid particles 30 are removed according to a technique that does not significantly degrade other parts of the structure. A mechanical process is typically used to remove particles 30 when they consist of polystyrene. For example, particles 30 can be removed by an ultrasonic/megasonic operation. A high-pressure water jet could alternatively be used to remove spheres 30. Particles 30 could also be chemically removed by dissolving them in a solvent such as xylene.

When an ultrasonic/megasonic operation is employed for the sphere removal, most of spheres 30 are removed during the ultrasonic part of the operation. The ultrasonic operation is typically performed by placing the wafer in a bath of de-ionized water with a small volume percentage (e.g., 1%) of Valtron SP2200 alkaline detergent (2-butylxyethanol and non-ionic surfactant) and subjecting the bath to an ultrasonic frequency for 10 min. After removing the wafer from the ultrasonic bath, the wafer is rinsed with de-ionized water. The megasonic operation, performed after the ultrasonic operation to remove the remainder of spheres 30, typically entails placing the wafer in another bath of de-ionized water with a small volume percentage (e.g., 0.5%) of Valtron SP2200 alkaline detergent and subjecting the bath to a megasonic frequency for 15 min. The wafer is subsequently removed from the megasonic bath, rinsed with de-ionized water, and spun dry.

A detergent which largely neutralizes the charges on particles 30 can be used in place of Valtron SP2200 detergent during both the ultrasonic and megasonic operations. The charge-neutralizing detergent typically includes ionic surfactant.

Figure 1E:
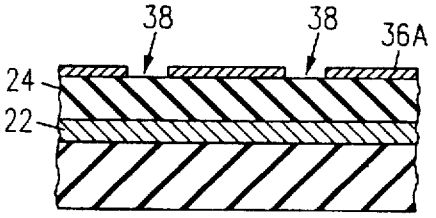
Figure 1F:
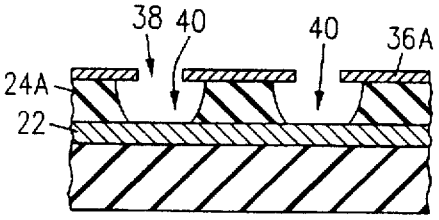
Figure 1G:
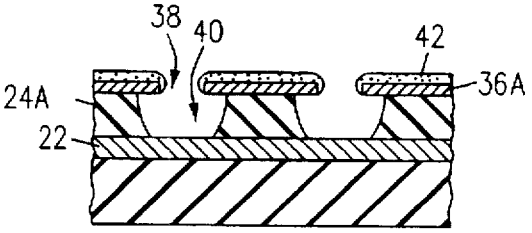

During the removal of particles 30, gate material portions 36B are removed to produce the structure of FIG. 1*e*. Gate openings 38 now extend through gate layer 36A down to insulating layer 24 at the locations of removed particles 30. Each gate opening 38 is vertically concentric with corresponding removed particle 30. Because particles 30 are generally spherical, gate openings 38 are generally circular.

Insulating layer 24 is etched through gate openings 38 to create corresponding dielectric openings (or dielectric open spaces) 40 through insulating layer 24 down to lower non-insulating region 22. See FIG. 1*f* in which interelectrode dielectric 24A is the remainder of insulating layer 24. The etch is typically performed in a manner that is at least partially isotropic. Consequently, dielectric openings 40 slightly undercut gate layer 36A. Each opening 40 is vertically centered on corresponding gate opening 38.

A lift-off layer 42 is formed on the top of gate layer 36A by evaporatively depositing a suitable lift-off material at a moderate angle, typically in the vicinity of 45°, relative to the upper surface of gate layer 36A while rotating the structure, relative to the source of the lift-off material, about an axis substantially perpendicular to the upper surface of interelectrode dielectric layer 24A. See FIG. 1*g*. Parts of lift-off layer 42 typically cover the edges of gate layer 36A at gate openings 38. The lift-off deposition angle is set at a sufficiently low value that substantially none of the lift-off material accumulates on lower non-insulating region 22 in dielectric open spaces 40.

The lift-off material is typically a metal such as aluminum. Alternatively, the lift-off material could be a dielectric such as aluminum oxide. The lift-off material could even be a metal/dielectric composite. The composition of the lift-off material is not particularly important as long as it can be selectively etched with respect to gate layer 36A, insulating layer 24A, lower non-insulating emitter region 22, and the material that forms the electron-emissive elements.

Figure 1H:
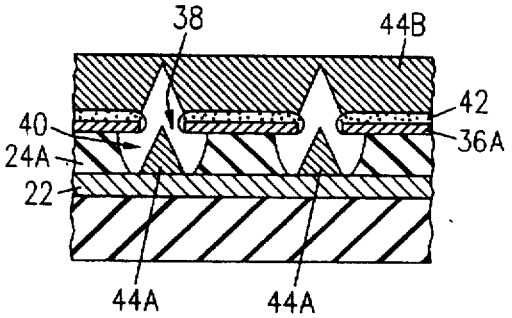

Electrically non-insulating emitter cone material is evaporatively deposited on top of the structure in a direction generally perpendicular to the upper surface of gate layer 36A. The emitter cone material accumulates on lift-off layer 42 and passes through gate openings 38 to accumulate on lower non-insulating region 22 in dielectric open spaces 40. The openings through which the cone material enters dielectric open spaces 40 progressively close as the cone material accumulates on non-insulating region 22. The deposition is performed until these openings fully close. As a result, the cone material accumulates in dielectric open spaces 40 to form respective electron-emissive elements 44A as shown in FIG. 1*h*. A continuous layer 44B of the cone material is simultaneously formed on lift-off layer 42. The cone material is normally a metal such as molybdenum, nickel, chromium, or niobium, or a refractory metal carbide such as titanium carbide.

Figure 1I:
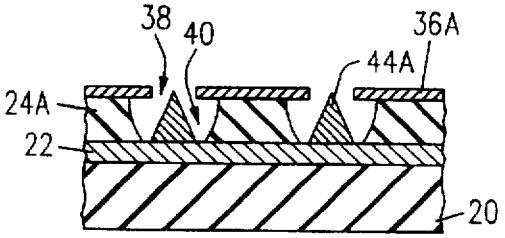

Lift-off layer 42 is now removed with a suitable etchant. During the removal of layer 42, excess cone material layer 44B is lifted off. FIG. 1*i* shows the resultant electron emitter. Each electron-emissive element 44A is vertically concentric with corresponding gate opening 38 and thus with the location of spherical particle 30 utilized to form that gate opening 38.

Since particles 30 were distributed across insulating layer 24 by an electrophoretic technique that significantly inhibited spheres 30 from touching one another (provided that the particle surface density corresponded to substantially less than a monolayer of particles 30), nearly all of electron-emissive elements 44A are shaped as simple cones having sharp tips. Very few of elements 44A have undesirable merged-cone shapes that result from two or more of spheres 30 touching one another. The turn-on voltage of electron-emissive elements 44A varies little from element 44A to element 44A. Accordingly, the uniformity of the electron emission across the area occupied by electron-emissive elements 44A is enhanced.

Gate layer 36A may be patterned into a group of gate lines running perpendicular to the emitter row electrodes of lower non-insulating region 22. The gate lines then serve as column electrodes. With suitable patterning being applied to gate layer 36A, the field emitter may alternatively be provided with separate column electrodes that contact portions of gate layer 36A and extend perpendicular to the row electrodes. This gate patterning and (when included) column-electrode formation are typically done prior to the formation of conical emissive elements 44A but can be done subsequent to the stage shown in FIG. 1*i*.

Figure 2A:
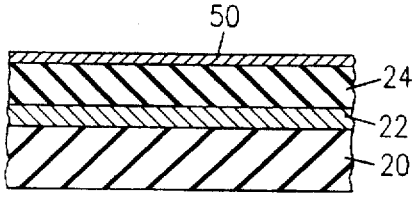
FIGS. 2*a*–2*i* are cross-sectional structural views representing another set of steps in manufacturing a gated electron emitter utilizing electrophoretic deposition in accordance with the invention.
Figure 2B:
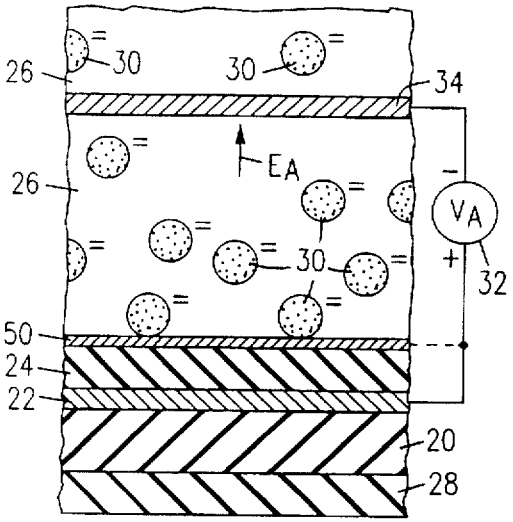
Figure 2C:
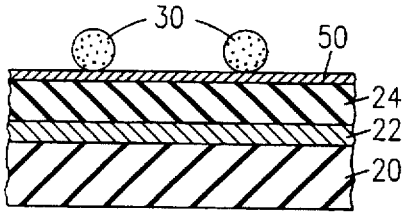

Instead of creating a lift-off layer for cone deposition just before creating emitter cones, the cone-deposition lift-off layer can be created at an earlier point in fabricating a gated field-emission cathode according to the teachings of the invention. FIGS. 2*a*–2*i* (collectively "FIG. 2") illustrate such a manufacturing process in which an electrophoretic technique is employed to deposit spherical particles that define openings in a lift-off layer provided over the cathode's gate layer. As indicated in FIG. 2*a*, the starting structure includes substrate 20, lower non-insulating region 22, and insulating layer 24 arranged in the previously described manner.

Also, an electrically non-insulating gate layer 50 is situated on insulating layer 24. Gate layer 50, normally a metal such as chromium, nickel, molybdenum, titanium, or tungsten, can be formed in various ways such as evaporative deposition, sputtering, and chemical vapor deposition. In contrast to the process of FIG. 1, the gate material deposition in the process of FIG. 2 need not be performed in a direction substantially perpendicular to the upper surface of insulating layer 24. Gate layer 50 is patterned in the manner described above for gate layer 36A. That is, gate layer may be patterned into parallel gate lines that serve as column electrodes and extend perpendicular to the emitter row electrodes. Alternatively, with layer 50 being suitably patterned, the structure may be furnished with separate column electrodes that contact portions of layer 50.

Structure 20/22/24/50 is placed in fluid 26 of the above-mentioned electrophoretic deposition apparatus. See FIG. 2*b*. Solid spherical particles 30 are again suspended in fluid 26. Voltage $V_A$ provided by voltage source 32 is applied between lower non-insulating region 22 and electrode 34 in the manner described above. Alternatively, gate layer 50 can be used in place of non-insulating region 22 as the positive electrode, or anode, during the electrophoretic deposition. In this case, applied voltage $V_A$ is 1–100 volts typically 15 volts, rather than 1–300 volts.

Upon being subjected to applied electric field $E_A$, particles 30 located between gate layer 50 and negative electrode 34 migrate towards gate layer 50. A portion of particles 30 accumulate on gate layer 50 in the same way that particles 30 accumulate on insulating layer 24 in the process of FIG. 1. Specifically, particles 30 accumulate on the top of gate layer 50 largely without touching one another. At the end of the desired particle-accumulation time, structure 20/22/24/50, with particles 30 attached to the upper surface of gate layer 50, is removed from the electrophoretic deposition apparatus and dried to produce the structure of FIG. 2*c*.

Figure 2D:
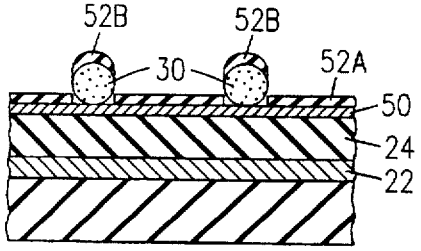
Figure 2E:
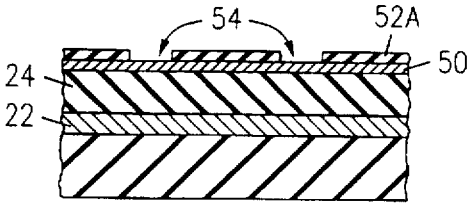

A suitable lift-off material is evaporatively deposited on top of the structure in a direction generally perpendicular to the upper surface of insulating layer 24. A layer 52A of the lift-off material accumulates on gate layer 50 in the space between particles 30 as indicated in FIG. 2*d*. Portions 52B of the lift-off material normally accumulate on the top halves of spheres 30.

To avoid having lift-off material portions 52B bridge to lift-off layer 52A, the lift-off material thickness is normally less than the average sphere radius. In contrast to the process of FIG. 1 where the thickness of gate layer 36A normally needs to be less than the average sphere radius, the avoidance of undesired bridging in the process of FIG. 2 places less constraint on the gate layer thickness than in the process of FIG. 1. This is especially true when the etch selectively of gate layer 50 to lift-off layer 52A —i.e., the gate material is etched much more than the lift-off material—is high during the below-described etch to form gate openings through layer 50 using lift-off layer 52A as an etch mask. For a given sphere diameter, gate layer 50 in the process of FIG. 2 can thus be thicker than gate layer 36A in the process of FIG. 1.

Particles 30 in the process of FIG. 2 are removed from the structure according to the technique utilized in the process of FIG. 1. During the particle removal, lift-off material portions 52B are lifted off. The structure of FIG. 2*d* is thereby produced. Openings 54 now extend through lift-off layer 52A at the locations of removed particles 30. Each opening 54 is vertically centered on corresponding removed sphere 30.

Figure 2F:
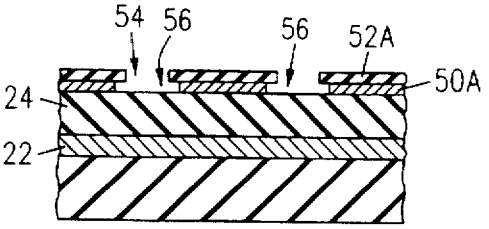
Figure 2G:
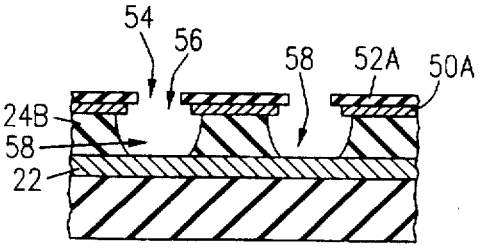

Gate layer 50 is etched through openings 54 to form corresponding gate openings 56 through layer 50 down to lower non-insulating region 24. See FIG. 2*f* in which item 50A is the patterned remainder of gate layer 50. The etch may be performed in a manner that causes the lateral areas of gate openings 56 to be respectively the same size as, or larger than, the lateral areas of corresponding openings 54. FIG. 2*f* depicts an example in which each gate opening 56 is laterally wider than corresponding opening 54 and thus slightly undercuts lift-off layer 52A. In either case, each gate opening 56 is vertically centered on corresponding opening 54.

Insulating layer 24 is etched through openings 54 and 56 to form corresponding dielectric openings 58 through layer 24 down to lower non-insulating region 22. See FIG. 2*g* in which item 24B is now the remainder of insulating layer 24. The etch is typically performed in a manner that is at least partially isotropic so that dielectric openings 58 slightly undercut gate layer 50A. Each dielectric open space 58 is vertically centered on corresponding openings 54 and 56.

Figure 2H:
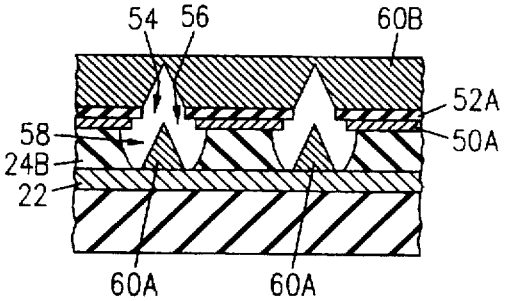

Electrically non-insulating emitter cone material. is deposited in the manner described above for the process of FIG. 1. The emitter cone material enters dielectric open spaces 58 to form electron-emissive elements 60A on lower non-insulating region 22 as shown in FIG. 2*h*. Each electron-emissive element 60A is vertically centered on corresponding gate opening 56. The cone material also accumulates on lift-off layer 52A to form a continuous layer 60B of the cone material. The emitter cone material again normally is a metal such as molybdenum, nickel, chromium, or niobium, or a refractory metal carbide such as titanium carbide.

Figure 2I:
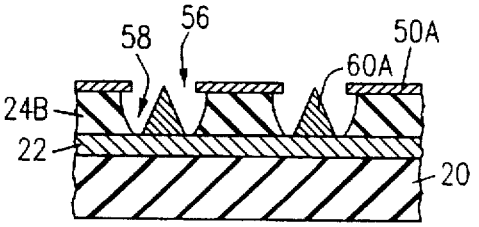

Lift-off layer 52A is removed with a suitable etchant during which cone-material layer 60B is lifted off. The resulting structure is shown in FIG. 2*i*.

As with electron-emissive elements 44A in the process of FIG. 1, each electron-emissive element 60A in the process of FIG. 2 is vertically centered on the location of corresponding removed sphere 30. For substantially the same reasons that nearly all of electron-emissive elements 44A in the field emitter of FIG. 1*i* are conical, nearly all of electron-emissive elements 60A in the field emitter of FIG. 2*i* are shaped as cones. The net result is that electron-emissive elements 60A provide highly uniform electron emission across the electron-emitting area.

One or more intermediate layers that perform various functions can be provided on insulating layer 24 before depositing spherical particles 30 and forming the gate layer. For example, such an intermediate layer can improve the distribution of particles 30 by inhibiting clumping of particles 30 as they accumulate on the intermediate layer. The intermediate layer also typically performs an adhesion function—i.e., the intermediate layer adheres well to both insulating layer 24 and the gate layer when the gate layer itself may not adhere well to the interelectrode dielectric material. When the intermediate layer consists of electrically non-insulating material, the intermediate layer forms part of the gate electrode.

FIGS. 3*a*–3*i* (collectively "FIG. 3") depict a process for manufacturing a gated field-emission cathode according to the invention's teachings utilizing an electrophoretic technique to deposit spherical particles 30 on an intermediate layer that substantially inhibits particle clumping. The process of FIG. 3 begins with structure 20/22/24 of FIG. 1*a*, repeated here as FIG. 3*a*.

Figure 3A:
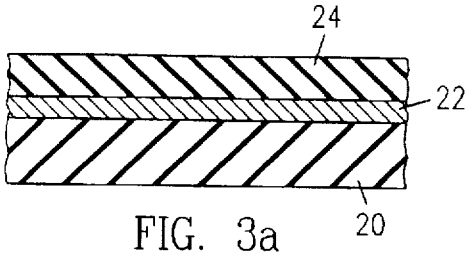
FIGS. 3*a*–3*i* are cross-sectional structural views representing a further set of steps in manufacturing a gated electron emitter utilizing electrophoretic deposition and electrochemical removal of excess emitter cone material in accordance with the invention.
Figure 3B:
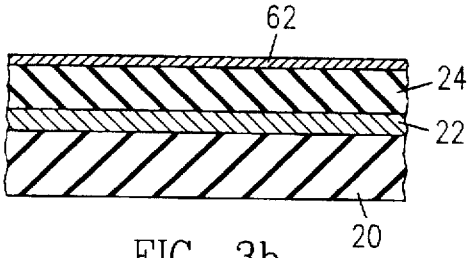
Figure 3C:
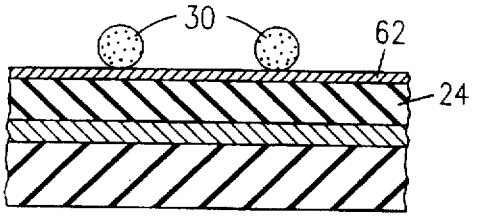

An intermediate layer 62 is deposited on insulating layer 24 to a relatively uniform thickness as shown in FIG. 3*b*. Intermediate layer 62 typically consists of material that adheres well to layer 24 and also adheres well to the gate material subsequently deposited on layer 62.

Insulating layer 24 sometimes has surface defects which, in the absence of intermediate layer 62, could cause spherical particles 30 to clump together as they are electrophoretically deposited across layer 24. Even if layer 24 does not have such surface defects, layer 24 may sometimes consist of material which, again in the absence of intermediate layer 62, could cause particles 30 to clump together during electrophoretic particle deposition across layer 24.

Intermediate layer 62 consists of material that significantly inhibits particles 30 from clumping together as they are electrophoretically deposited on layer 62. Since intermediate layer 62 overlies insulating layer 24, the use of layer 62 substantially overcomes the clumping problem during the electrophoretic particle deposition. By inhibiting particle clumping, the particle surface density can be increased.

Intermediate layer 62 may consist of electrically non-insulating material or electrically insulating material dependent on the desired adhesion and clumping-inhibiting characteristics. Layer 62 typically consists of metal, preferably chromium having a thickness of 5–10 nm, typically 7.5 nm. As evidenced by experiments performed under our direction, clumping of small electrophoretically deposited polystyrene spheres on a freshly deposited chromium surface is considerably less than the clumping of such particles on a silicon oxide surface, especially when the silicon oxide surface has been subjected to additional processing. Using chromium to form intermediate layer 62 thereby significantly reduces clumping during electrophoretic deposition when insulating layer 24 consists of silicon oxide. Chromium also adheres well to silicon oxide. Since layer 62 consists of metal, part of layer 62 later forms part of the gate electrode.

Spherical particles 30 are electrophoretically deposited across the top of intermediate layer 62. See FIG. 3*c*. The electrophoretic deposition is performed in the manner generally described above. Layer 62 is used as the deposition anode. As a consequence, applied voltage $V_A$ is reduced to a value in the range of 1–100 volts. The particle surface density across layer 62 is typically on the order of $5\times10^8$ particles/cm$^2$.

After completing the electrophoretic sphere deposition, electrically non-insulating gate material is deposited in two stages on top of the structure in a direction generally perpendicular to the upper surface of insulating layer 24. Both stages of the deposition are typically performed by collimated evaporation. The gate material in the first deposition stage differs from the gate material in the second deposition stage.

Figure 3D:
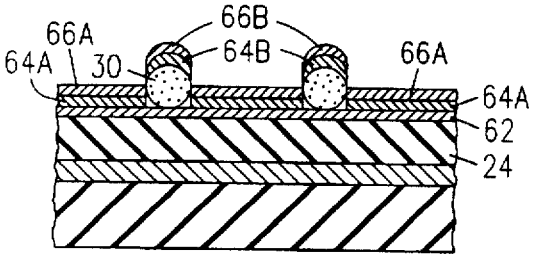

The first stage gate material accumulates on intermediate layer 62 in the space between particles 30 to form a gate sublayer 64A of relatively uniform thickness as shown in FIG. 3*d*. Portions 64B of the first stage material simultaneously accumulate on the top halves of spheres 30. The second stage gate material accumulates on gate sublayer 64A in the space between particles 30 to form another gate sublayer 66A of relatively uniform thickness. Portions 66B of the second stage material accumulate on first stage portions 64B during the formation of gate sublayer 66A.

The first stage gate material can be chromium, molybdenum, titanium, or tungsten. When intermediate layer 62 consists of chromium, the first stage gate material typically consists of chromium deposited to a thickness of 2.5–7.5 nm, typically 5 nm. The chromium in gate sub-layer 64A improves the adhesion of gate sublayer 66A. The second stage gate material typically consists of gold deposited to a thickness of 20–50 nm, typically 30 nm.

Figure 3E:
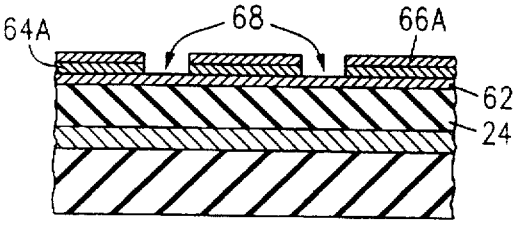

Spheres 30 are removed according to one of the techniques employed in the process of FIG. 1 so as to remove gate material portions 64B and 66B. FIG. 3*e* shows the resultant structure. Gate sublayers 64A and 66A form a composite gate layer 64A/66A through which largely circular gate openings 68 extend down to intermediate layer 62. Since gate openings 68 are created during the deposition of the first and second stage gate materials over spheres 30 without the necessity for etching the second stage gate material, gold through which it is difficult to accurately etch small openings—i.e. openings whose diameters are typically less than 1 μm—is suitable for the second stage gate material.

Figure 3F:
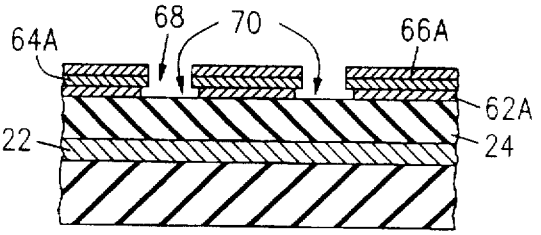

Using composite gate layer 64A/66A as an etch mask, intermediate layer 62 is uniformly etched through gate openings 68 to form largely circular intermediate openings 70 down to insulating layer 24. FIG. 3*f* illustrates the resultant structure in which item 62A is the remainder of intermediate layer 62. Remaining intermediate layer 62A forms a lower part of the gate electrode.

The intermediate-layer etch, typically performed with a chlorine plasma, can be conducted in a fully anisotropic (substantially unidirectional) manner or in a partly isotropic manner. FIG. 3*f* illustrates an example in which the intermediate layer etch is partly isotropic so that intermediate openings 70 slightly undercut gate sublayer 64A. Each intermediate opening 70 is vertically aligned with corresponding gate opening 68 to form a composite gate opening 68/70.

Using composite gate layer 62A/64A/66A as an etch mask, insulating layer 24 is etched through composite gate openings 68/70 to form dielectric open spaces (or dielectric openings) 72 down to lower non-insulating emitter region 22. See FIG. 3*g* in which item 24C is the remainder of insulating layer 24. The interelectrode dielectric etch is normally performed in the manner described above for the process of FIG. 1 so that dielectric open spaces 72 undercut composite gate layer 62A/64A/66A slightly.

Figure 3G:
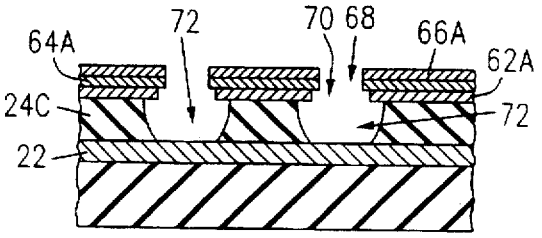
Figure 3H:
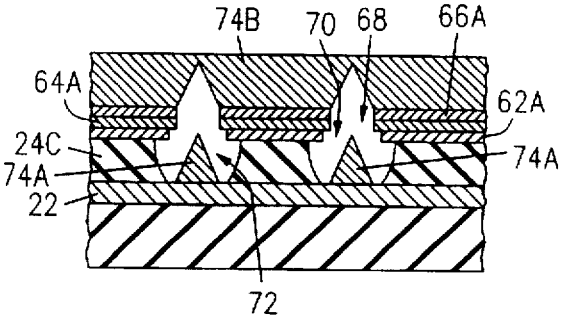

Electrically non-insulating emitter cone material typically consisting of any of the materials described above for the process of FIG. 1, provided that the emitter cone material differs from the gate material, is evaporatively deposited on top of the structure of FIG. 3*g* in a direction generally perpendicular to the upper surface of insulating layer 24C. The cone material accumulates on gate layer 62A/64A/66A and passes through gate openings 68/70 to form corresponding conical electron-emissive elements 74A as shown in FIG. 3*h*. A continuous layer 74B of the emitter cone material simultaneously forms on upper gate sublayer 66A.

Figure 3I:
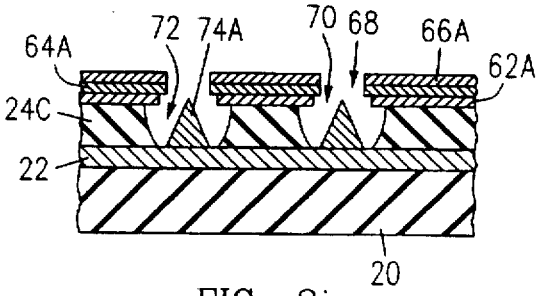

Excess cone material layer 74B is electrochemically removed in the manner generally described in Spindt et al. U.S. patent application Ser. No. 8/610,729, filed 5 Mar., 1996, the contents of which are incorporated by reference herein. The resultant field emitter is depicted in FIG. 3*i*. Electron-emissive cones 74A are externally exposed through gate openings 68/70.

Each electron-emissive cone 74A is vertically aligned to its composite gate opening 68/70. Since spheres 30 determine the locations of original gate openings 68, the locations of cones 74A are determined by spheres 30. Also, the base of each cone 74A is largely circular. The comments made above about achieving highly uniform electron emission in an electron emitter manufactured according to the process of FIG. 1 apply equally well to the field emitter of FIG. 3*i*.

Figure 4:
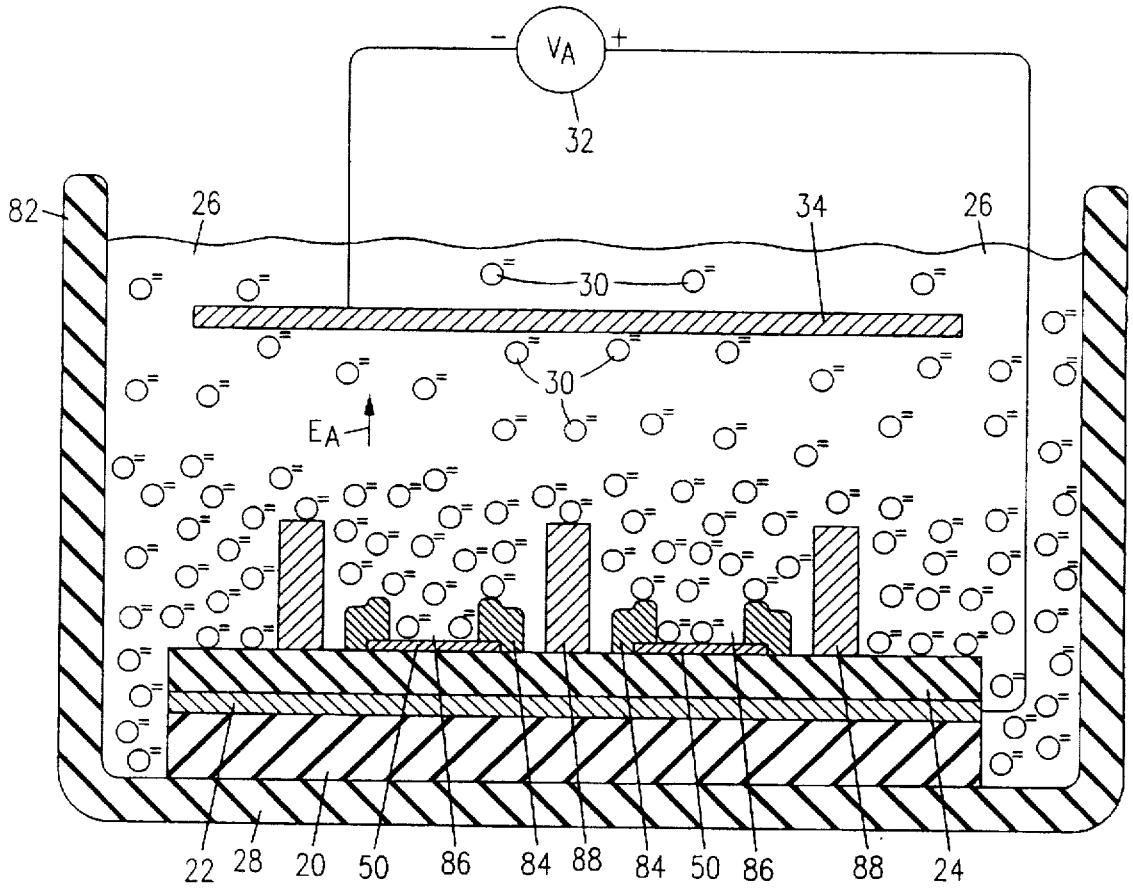
FIG. 4 is a schematic cross-sectional view of an apparatus for performing electrophoretic deposition in the process of FIGS. 1*a*–1*i*, 2*a*–2*i*, or 3*a*–3*i*.

FIG. 4 illustrates the electrophoretic deposition apparatus in more detail. Bottom wall 28 is connected to a side wall 82 to form a container for fluid 26. In FIG. 4, the electrophoretic deposition apparatus contains the structure of FIG. 2*b*. The patterning of gate layer 50 into separate portions is visible in FIG. 4. A column electrode 84 overlies each gate line. Apertures 86 extends through column electrodes 84 to expose parts of the gate portions. The field-emission cathode shown in FIG. 4 also has focus electrodes 88 that run parallel to column electrodes 84.

As indicated in FIG. 4, some of particles 30 may accumulate on top of column electrodes 84. This is not detrimental because the electrical properties, including continuity to gate layer 50, of column electrodes 84 are not significantly changed when particles 30 are removed from electrodes 84. Likewise, some of particles 30 may accumulate in a non-detrimental manner on focus electrodes 88.

Particles 30 can be replaced with uncharged dielectric spherical particles. Upon being subjected to applied electric field $E_A$, the uncharged dielectric particles become polarized. When field $E_A$ is non-uniform and converges towards the partially finished field-emission structure, the uncharged dielectric particles move towards the partially finished field emitter and accumulate on insulating layer 24 in the process of FIG. 1, on gate layer 50 in the process of FIG. 2, or on intermediate layer 62 in the process of FIG. 3. In this case, the particle deposition process is termed dielectrophoretic deposition.

FIG. 5 depicts a typical example of the core active region of a flat-panel CRT display that employs an area field emitter, such as that of FIG. 2*i* (or 1*i*), manufactured according to the invention. Substrate 20 forms the backplate for the CRT display. Lower non-insulating emitter region 22 is situated along the interior surface of backplate 20 and consists of electrically conductive layer 22A and overlying electrically resistive layer 22B.

One column electrode 84 is depicted in FIG. 5. Each column-electrode aperture 86 exposes a multiplicity of conical electron-emissive elements 60A.

A transparent, typically glass, faceplate 90 is located across from backplate 20. Light-emitting phosphor regions 92, one of which is shown in FIG. 5, are situated on the interior surface of faceplate 90 directly across from corresponding column-electrode aperture 86. A thin electrically conductive light-reflective layer 94, typically aluminum, overlies phosphor regions 92 along the interior surface of faceplate 90. Electrons emitted by electron-emissive elements 60A pass through light-reflective layer 94 and cause phosphor regions 92 to emit light that produces an image visible on the exterior surface of faceplate 90.

The core active region of the flat-panel CRT display typically includes other components not shown in FIG. 5. For example, a black matrix situated along the interior surface of faceplate 90 typically surrounds each phosphor region 92 to laterally separate it from other phosphor regions 92. Focusing ridges (shown in FIG. 4) provided over interelectrode dielectric layer 24B help control the electron trajectories. Spacer walls are utilized to maintain a relatively constant spacing between backplate 20 and faceplate 90.

When incorporated into a flat-panel display of the type illustrated in FIG. 5, a field emitter manufactured according to the invention operates in the following way. Light-reflective layer 94 serves as an anode for the field-emission cathode. The anode is maintained at high positive voltage relative to the gate and emitter lines.

When a suitable voltage is applied between (a) a selected one of the emitter row electrodes in lower non-insulating emitter region 22 and (b) a selected one of the column electrodes that are formed with or contact portions of gate layer 36A, 50A, or 62A/64A/66A, the so-selected gate portion extracts electrons from the electron-emissive elements at the intersection of the two selected electrodes and controls the magnitude of the resulting electron current. Desired levels of electron emission typically occur when the applied gate-to-cathode parallel-plate electric field reaches 20 volts/μm or less at a current density of 1 mA/cm$^2$ as measured at the phosphor-coated faceplate in a flat-panel CRT display when phosphor regions 92 are high-voltage phosphors. Upon being hit by the extracted electrons, phosphor regions 92 emit light.

Directional terms such as "lower" and "down" have been employed in describing the present invention to establish a frame of reference by which the reader can more easily understand how the various parts of the invention fit together. In actual practice, the components of an electron-emitting device may be situated at orientations different from that implied by the directional terms used here. The same applies to the way in which the fabrication steps are performed in the invention. Inasmuch as directional terms are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For example, particles 30 can have functional groups that provide amounts of negative charge other than double negative charges. Negatively charged particles 30 can be replaced with positively charged spherical particles. The electrode polarities are then reversed from those described above. Particles 30 can be partly charged and partly uncharged.

The deposition of solid material over spheres 30 for creating gate layer 36A in the process of FIG. 1, for creating lift-off layer 52A in the process of FIG. 2, or for creating composite gate layer 64A/66A in the process of FIG. 3 can be performed in a direction not generally perpendicular to the upper surface of insulating layer 24. For example, the solid material can be deposited by a partially collimated or uncollimated technique such as high-pressure sputtering. Electrophoretic and/or dielectrophoretic deposition of particles can be used to directly define openings in layers other than gate layer 36A, lift-off layer 52A, and composite gate layer 64A/66A.

After creating a structure in which gate openings extend through a gate layer down to insulating layer 24 above lower non-insulating emitter region 22, the thickness of the gate layer can be increased by selectively depositing further electrically non-insulating gate material on the gate layer. The further gate material deposition can be performed by an electrochemical technique. In general, the further gate material deposition can be performed before or after removing particles 30.

The electrophoretically or dieletrophoretically deposited particles can have shapes other than spheres. The processes of FIGS. 1–3 can be revised to make electron-emissive elements of non-conical shape. Excess cone material layer 36B in the process of FIG. 1 or 2 can be removed electrochemically according to the techniques described in Spindt et al. U.S. patent application Ser. No. 8/610,729, cited above.

A transparent electrically non-insulating layer situated between faceplate 90 and phosphors 92 and consisting, for example, of indium-tin oxide can be used as the anode in place of light-reflective layer 94. Substrate 20 can be deleted if lower non-insulating region 22 is a continuous layer of sufficient thickness to support the structure. Insulating substrate 20 can be replaced with a composite substrate in which a thin insulating layer overlies a relatively thick non-insulating layer that furnishes structural support.

Mechanisms other than electrophoretic or/and dielectrophoretic action may assist in inhibiting particles 30 from clumping along the deposition surface when particles 30 are subjected to applied electric field $E_A$. In general, the mechanism which causes particles 30 to be significantly inhibited from touching one another broadly consists of the influence of applied field $E_A$.

The electron emitters produced according to the manufacturing processes of the invention can be employed to make flat-panel devices other than flat-panel CRT displays. In particular, the present electron emitters can be used in general vacuum environments that require gated electron sources. Various modifications and applications may thus be made by those skilled in the art without departing from the true scope and spirit of the invention as defined in the appended claims.

We claim:

1. A method of fabricating an electron-emitting device, the method comprising the steps of:

subjecting particles suspended in a fluid to an electric field to cause a multiplicity of the particles to move towards, and accumulate over, a major surface of a structure placed in the fluid;

removing the structure, including the accumulated particles, from the fluid;

depositing selected solid material over the major surface at least in space between the accumulated particles; and removing the particles, including material overlying the particles, from the structure such that the selected solid material remaining over the major surface forms a solid layer through which a like multiplicity of openings respectively extend at locations of the removed particles.

2. A method as in claim 1 wherein the particles are largely spherical.

3. A method as in claim 1 wherein the subjecting step entails producing the electric field across at least part of the fluid.

4. A method as in claim 3 wherein the field-producing step comprises applying a voltage between an electrode of the structure and an overlying further electrode situated in the fluid.

5. A method as in claim 1 wherein the fluid comprises liquid.

6. A method as in claim 1 wherein the fluid comprises gas.

7. A method as in claim 1 where the particles comprise polystyrene.

8. A method as in claim 1 wherein at least part of the particles are electrically charged, the subjecting step being at least partially performed electrophoretically.

9. A method as in claim 8 wherein the particles bear charge of a first polarity and, relative to the further electrode situated in the fluid, the electrode of the structure is biased at a second polarity opposite to the first polarity.

10. A method as in claim 9 wherein the first and second polarities respectively are negative and positive.

11. A method as in claim 9 wherein accumulation of one of the particles over the major surface significantly inhibits any of the other particles from accumulating close to that particle over the major surface.

12. A method as in claim 11 wherein substantially less than a monolayer of the particles accumulate over the major surface.

13. A method as in claim 11 wherein the particles accumulate over the major surface to a surface density of $10^7$–$10^{11}$ particles/cm$^2$.

14. A method as in claim 8 further including, prior to the subjecting step, the step of introducing the particles into the fluid, at least part of the particles being electrically charged prior to the particle introducing step.

15. A method as in claim 8 wherein the particles comprise polymeric material chemically terminated with electrically charged groups, at least part of the particles being electrically charged with the charged groups prior to being combined with the fluid.

16. A method as in claim 8 further including, prior to the subjecting step, the step of introducing the particles into the fluid to electrically charge at least part of the particles, the fluid including a component that causes these particles to become electrically charged.

17. A method as in claim 8 wherein the particles comprises material that is substantially electrically neutral prior to being combined with the fluid.

18. A method as in claim 1 wherein at least part of the particles consist primarily of dielectric material, the subjecting step being at least partially performed dielectrophoretically.

19. A method as in claim 1 wherein the major surface comprises a first surface portion and a second surface portion formed with material of different type than the first portion, the particles reaching a greater surface density along the second portion than the first portion.

20. A method as in claim 19 wherein the first and second portions respectively comprise electrically insulating material and electrically non-insulating material.

21. A method as in claim 1 wherein the structure comprises a substructure and an intermediate layer provided over the substructure to inhibit clumping of the particles that accumulate on the intermediate layer during the subjecting step.

22. A method as in claim 21 further including the step of etching the intermediate layer through the openings in the solid layer to form corresponding intermediate openings through the intermediate layer down to the substructure.

23. A method as in claim 22 wherein the intermediate layer comprises electrically non-insulating material.

24. A method as in claim 1 wherein the structure comprises a lower electrically non-insulating region and an electrically insulating layer overlying the lower non-insulating region, the method further including the step of etching the insulating layer through the openings in the solid layer to form corresponding dielectric openings substantially through the insulating layer down to the lower non-insulating region.

25. A method as in claim 24 further including the step of forming a like multiplicity of electron-emissive elements over the lower non-insulating region such that each electron-emissive element is at least partially situated in a corresponding one of the dielectric openings.

26. A method as in claim 25 wherein the solid layer comprises an electrically non-insulating gate layer.

27. A method as in claim 25 wherein the structure includes an electrically non-insulating gate layer formed over the insulating layer, the method further including, prior to the insulating-layer etching step, the step of etching the gate layer through the openings in the solid layer to form corresponding gate openings through the gate layer.

28. A method as in claim 27 wherein the electron-emissive element forming step comprises:

depositing electrically non-insulating emitter material over the solid layer and into the dielectric openings to at least partially form the electron-emissive elements; and removing the solid layer to substantially remove any of the emitter material accumulated over the solid layer.

29. A method as in claim 24 wherein the structure further includes an intermediate layer provided over the insulating layer to inhibit clumping of the particles that accumulate on the intermediate layer during the subjecting step, the method further including the step of etching the intermediate layer through the openings in the solid layer to form corresponding intermediate openings through the intermediate layer down to the insulating layer, the insulating-layer etching step including etching the insulating layer through the intermediate openings.

30. A method as in claim 29 further including the step of forming a like multiplicity of electron-emissive elements over the lower non-insulating region such that each electron-emissive element is at least partially situated in a corresponding one of the dielectric openings.

31. A method as in claim 30 wherein the intermediate layer comprises electrically non-insulating material.

32. A method as in claim 30 wherein the intermediate layer adheres to both the insulating layer and the solid layer.

33. A method as in claim 30 wherein the solid layer comprises an electrically non-insulating gate layer.

34. A method as in claim 30 wherein the electron-emissive element forming step comprises:

depositing electrically non-insulating emitter material over the solid layer and into the dielectric openings to at least partially form the electron-emissive elements; and electrochemically removing at least part of the emitter material accumulated over the solid layer.

35. A method as in claim 1 wherein the structure comprises a lower electrically non-insulating region, an electrically insulating layer situated over the lower non-insulating region, and a gate layer situated over the insulating layer, the method further including the steps of:

etching the gate layer through the openings in the solid layer to form corresponding gate openings through the gate layer;

etching the insulating layer through the gate openings to form corresponding dielectric openings substantially through the insulating layer down to the lower non-insulating region; and forming a like multiplicity of electron-emissive elements over the lower non-insulating region such that each electron-emissive element is at least partially situated in a corresponding one of the dielectric openings.

36. A method as in claim 1 wherein the structure comprises a lower electrically non-insulating region, an electrically insulating layer provided over the lower non-insulating region, and an intermediate layer provided over the insulating layer to inhibit clumping of the particles that accumulate on the intermediate layer during the subjecting step, the solid layer constituting an electrically non-insulating gate layer wherein the openings in the solid layer comprise gate openings, the method further including the steps of:

etching the intermediate layer through the gate openings to form corresponding intermediate openings through the intermediate layer;

etching the insulating layer through the intermediate and gate openings to form corresponding dielectric openings through the insulating layer down to the lower non-insulating region;

depositing electrically non-insulating emitter material over the gate layer and into the dielectric openings to at least partially form electron-emissive elements over the lower non-insulating region; and electrochemically removing at least part of the emitter material accumulated over the gate layer.

* * * * *